US008061062B2

(12) United States Patent
Giovale

(10) Patent No.: US 8,061,062 B2
(45) **Date of Patent: *Nov. 22, 2011**

(54) MODULAR SNOW TRAVEL SYSTEM FOR COMMON FOOTWEAR

(75) Inventor: Daniel G. Giovale, Flagstaff, AZ (US)

(73) Assignee: Kahtoola Inc., Flagstaff, AZ (US)

( * ) Notice: Subject to any disclaimer, the term of this patent is extended or adjusted under 35 U.S.C. 154(b) by 811 days.

This patent is subject to a terminal disclaimer.

(21) Appl. No.: 12/132,945

(22) Filed: Jun. 4, 2008

(65) Prior Publication Data

US 2008/0244933 A1 Oct. 9, 2008

Related U.S. Application Data

(63) Continuation-in-part of application No. 11/622,038, filed on Jan. 11, 2007, now Pat. No. 7,707,749.

(60) Provisional application No. 60/758,890, filed on Jan. 12, 2006.

(51) Int. Cl.
*A43B 5/00* (2006.01)

(52) U.S. Cl. ..... 36/122; 36/124

(58) Field of Classification Search ..... 036/122–125, 036/7.1 R, 67 A
See application file for complete search history.

(56) References Cited

U.S. PATENT DOCUMENTS

| | | | | |
|---|---|---|---|---|
| 5,341,582 | A * | 8/1994 | Liautaud | 36/7.6 |
| 5,901,471 | A * | 5/1999 | Warner | 36/124 |
| 6,256,908 | B1 * | 7/2001 | Warner | 36/124 |
| 6,374,518 | B2 * | 4/2002 | Warner | 36/124 |
| 7,707,749 | B2 * | 5/2010 | Giovale et al. | 36/124 |

* cited by examiner

*Primary Examiner* — Marie Patterson
(74) *Attorney, Agent, or Firm* — Connolly Bove Lodge & Hutz LLP

(57) ABSTRACT

A snowdeck includes a latching mechanism for detachable mounting to a traction component such as a boot. The latching mechanism includes a base member which is mounted to the snowdeck and which has a recess for accommodating a longitudinal slider which is movable longitudinally to and from a first position and a second position. The slider has a longitudinal wall and a lateral wall which, in combination with a wall of the recess defines a space. The space is filled with a filler member, preferably made of a compressible and resilient material and preferably which is in the form of a removable insert.

13 Claims, 6 Drawing Sheets

14
40
42
44
60
66
102
104
98
46
52
50
48

MODULAR SNOW TRAVEL SYSTEM FOR COMMON FOOTWEAR

CROSS-REFERENCE TO RELATED APPLICATION

This application is a continuation-in-part of Ser. No. 11/622,038, filed Jan. 11, 2007 now U.S. Pat. No. 7,707,749 which is based upon provisional application Ser. No. 60/758,890, filed Jan. 12, 2006, all of the details of which are incorporated herein by reference thereto.

BACKGROUND OF INVENTION

Various attempts have been made to provide structure for securing footing on a variety of slippery surfaces. Such attempts have included footwear such as overboots into which the conventional footwear would be placed with traction cleats attached to the bottom of the overboot sole. This would help provide improved traction when walking or running on ice, snow or other slippery surfaces.

Independently of such cleated overboots, for use in deep snow or where greater stability is required a snowdeck has also been used. Such snowdeck could be attached to the user's footwear and would be of enlarged size to facilitate walking in deep snow.

Until the present invention no one has developed a cleated overboot that provides all of the benefits that may be desirable for such a device. Moreover, until the present invention, no one has provided a cleated overboot that can be readily attached and detached from a snowdeck so as to allow for quick and easy transitions between smooth slippery conditions and deep snow conditions.

SUMMARY OF INVENTION

An object of this invention is to provide an improved system for securing footing on a variety of slippery surfaces.

A further object of this invention is to provide such a system which includes a first traction component having the capability of itself providing secure footing on various surfaces, but also having the capability of being mounted to a snowdeck to increase the secure footing.

The invention may be used where the first traction component includes at least one traction cleat. The snowdeck has a releasable locking mechanism for selective engagement with the traction cleat so that the traction cleat has the dual function of assisting in providing secure footing when the first traction component is used alone or for acting as structure to mount the first traction component to the snowdeck.

In a preferred practice of this invention the releasable locking mechanism includes a longitudinal slider movable to and from first and second positions. The longitudinal slider is located in a recess in a base. An open area is located at the slider with the size of the open area depending on whether the slider is in the first position or the second position. The open area is preferably filled with a resilient foam insert to prevent contamination from collecting and freezing in the open area. Preferably there are two open areas each of which is filled with its own insert.

THE DRAWINGS

DETAILED DESCRIPTION

The present invention is directed to providing a modular snow travel system for common footwear. In one practice of the invention a first flexible or inflexible traction component is provided which is adapted to be attached to conventional footwear such as running shoes or other types of footwear or to the foot itself. The first traction component could be an overboot which will be described with greater particularity or could simply be some form of binding assembly that could be attached to the footwear or the foot and fulfill all the other basic functions required of the first traction component and would be secured only in part over the footwear or foot.

The first traction component has at least one traction cleat attached thereto, preferably in the forefoot region, so as to provide improved traction when walking or running on ice, snow or other slippery surfaces. For use in deep snow or where greater stability is required, a snowdeck is also provided that includes a locking mechanism adapted to secure to at least one of the cleats of the first traction component and attach it to the snowdeck. Preferably the attachment to the snowdeck allows for the first traction component to pivot relative to the snowdeck to allow for ease in walking or running. Also preferably, the snowdeck includes additional traction cleats or claws attached thereto.

The present invention provides a number of improved first traction components that are adapted to attach to a wide variety of conventional footwear styles, including boots, shoes, and running shoes or to the foot. Preferably the first traction components include one or more buckle systems to allow for quick attachment to and removal from the foot/footwear. These various forms of first traction components provide greatly improved traction for the wearer while also providing additional benefits, such as with the overboot embodiments that provide improved insulation and protection from snow, dirt, or water infiltration of the footwear.

Traction cleats may be provided on the forefoot, rear-foot, or mid-foot of the first traction component, or any combination thereof.

The various embodiments of the snowdecks allow for easy step-in addition of additional floatation and/or greater stability for the wearer. Preferably at least one of the traction cleats of the first traction component is adapted to "click in" to a binding or locking mechanism on the snowdeck. When the deck is no longer required, the locking mechanism allows for quick disengaging of the first traction component. Alternatively, utilizing the quick attachment systems on the first traction components, the wearer can leave the first traction component attached to the snowdeck and convert between conventional footwear and something akin to a conventional snowdeck configuration. Various snowdeck configurations and binding systems may be used within the scope of the present invention.

Figure 1:
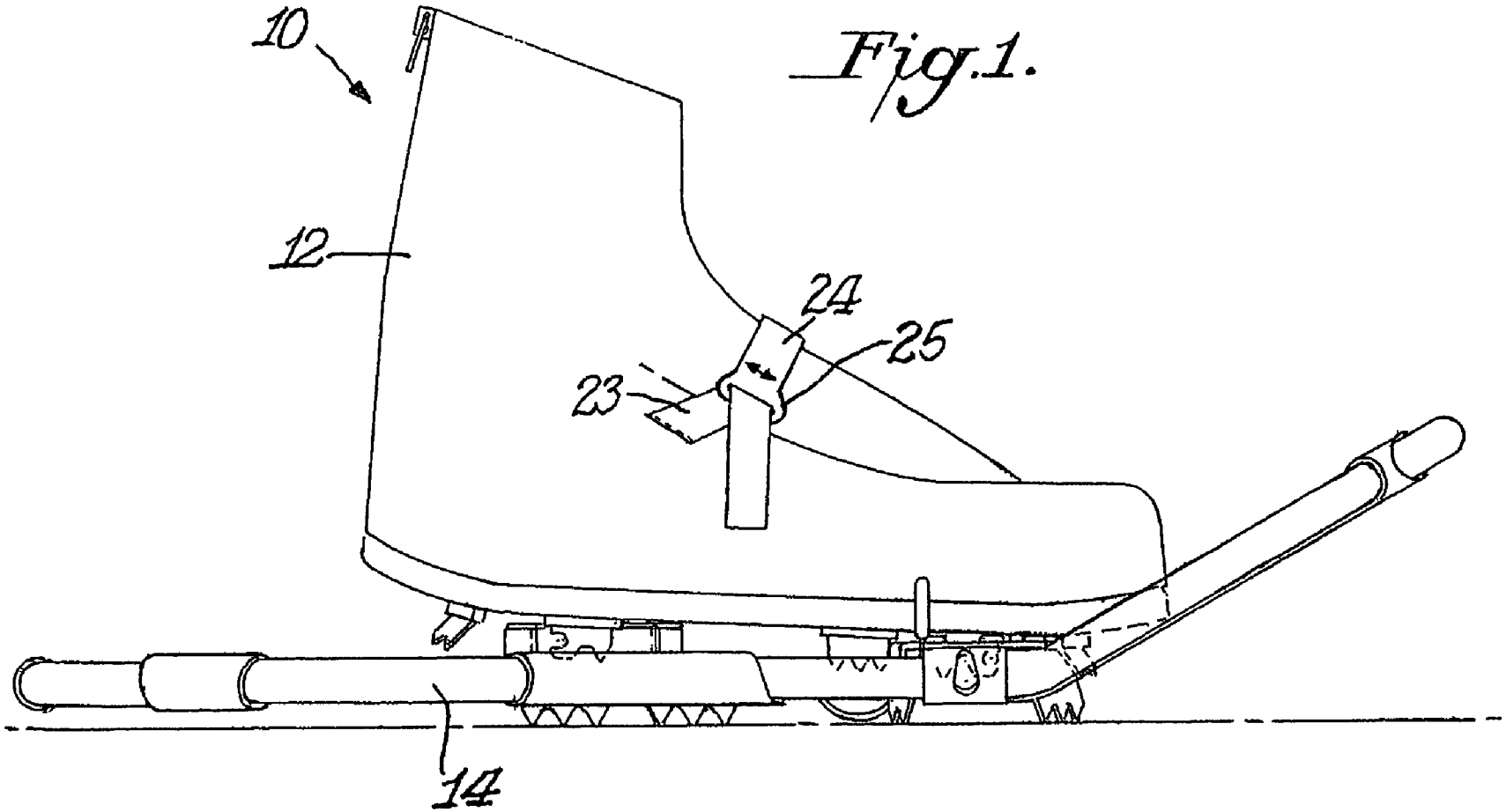
FIG. 1 is a side elevational view of a modular snow travel system in accordance with this invention.

The following description will be directed to a preferred form of modular snow travel system. Such system 10 is illustrated in FIG. 1. As shown therein a first traction component, which in FIG. 1 is in the form of an overboot 12, is detachably mounted to a snowdeck 14.

Figure 2:
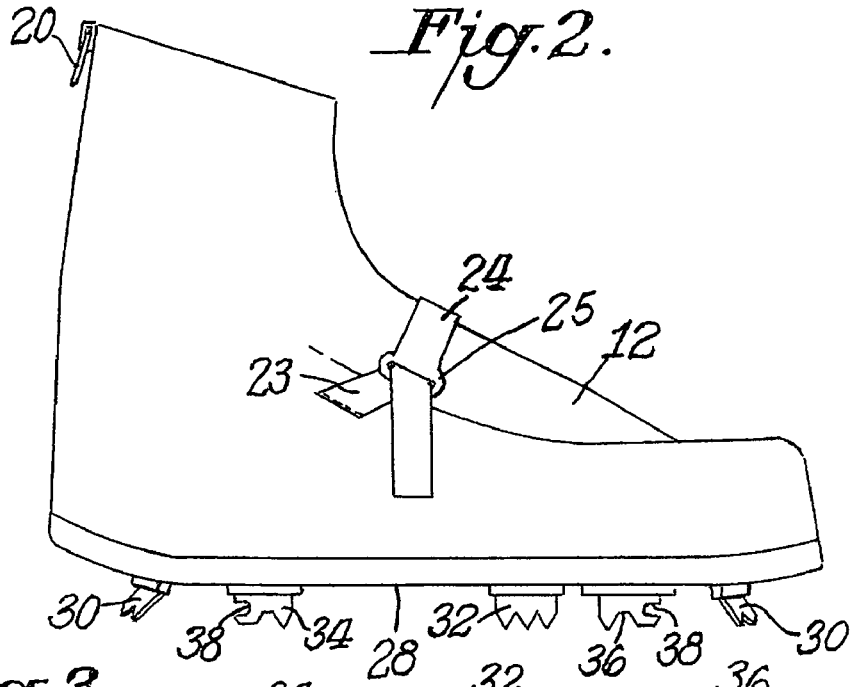
FIG. 2 is a side elevational view of the overboot component of the system shown in FIG. 1.
Figure 3:
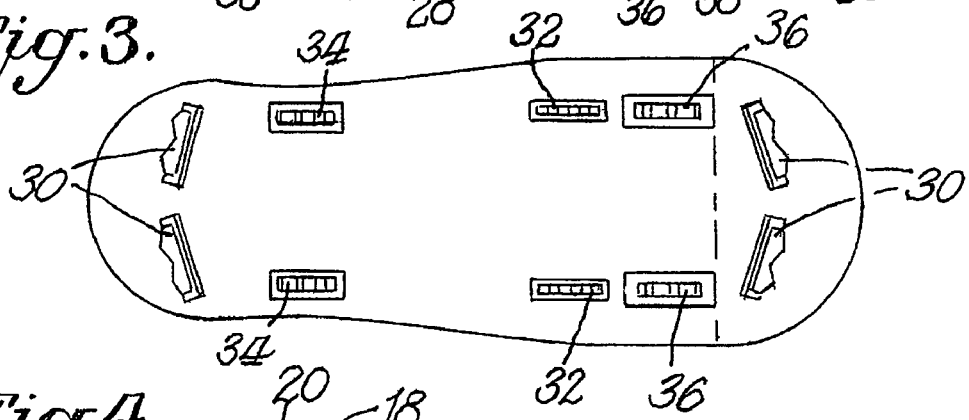
FIG. 3 is a bottom plan view of the overboot shown in FIG. 2.
Figure 4:
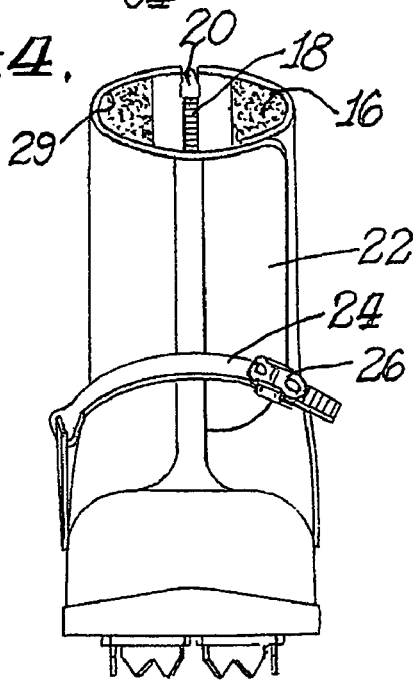
FIG. 4 is a front elevational view of the overboot shown in FIGS. 2-3.

FIGS. 2-4 illustrate the overboot 12 in greater detail. As shown therein overboot 12 can include structure to facilitate a wearer readily inserting the wearer's foot into the overboot 12. This can be done by slipping the foot and any footwear into the opening 16 at the top of the overboot 12. Opening 16 can be increased in size by providing, for example, a zipper 18 having a slider 20 on the back of overboot 12. In addition, the front of the footwear could include a flap 22 that could be opened and then later closed and held in the closed condition through any suitable fastening arrangement such as illustrated by strap structure 24 and fastener structure, such as ratchet 26. It is to be understood that these forms of enlarging the opening 16 may vary in any conventional manner. Preferably, the front opening 16 may be additionally secured through use of supplemental closure devices, such as hook-and-loop fasteners, latches, laces, zippers, or the like, that can both aid in more securely holding the overboot 12 to the wearer and to assist in reducing snow, dirt or water infiltration into the overboot 12.

As best shown in FIGS. 1-2 and 4 an advantageous feature of overboot 12 is the inclusion of a loop 23 on each side of the overboot which slides through a strap loop 25 allowing for the precise placement of the strap structure 24 to be adjusted up or down the boot to accommodate laces hot spots. As best shown in FIG. 4 the strap structure 24 also includes a series of transverse teeth 27 which cooperate with ratchet 26 for providing the adjustability of the opening 16 of overboot 12.

The lower surface of the sole 28 of overboot 12 includes sets of cleats located at any suitable location in order to provide the desired traction to secure footing on a slippery surface. Such sets of cleats are preferably around the periphery of the sole 28 and could include cleats 30 as illustrated located at the toe and heel portions of sole 28. Additional sets of cleats 32, 34 and 36 also extend from the sole. Preferably the cleats on one longitudinal side of overboot 12 are mirror images of those on the other longitudinal side.

As best shown in FIG. 2 a distinctive feature of traction cleats 36 is that each traction cleat includes a latch in the form of a cutout forming an exposed hook portion 38 facing toward the toe, for purposes later described. Other forms of latch structure could also be used instead of an exposed hook portion. Examples of such latch structure include various shaped cutouts or holes or any other form of opening which would be engaged by a catch on the snowdeck, as later described. The latch could also be an exposed protrusion on the cleat 36 for engagement with a catch on the snowdeck.

As illustrated in FIG. 4 overboot 12 could be lined with any suitable insulation material 29 to provide insulation and protection from snow, dirt or water infiltration of the footwear. The overboot itself would be made of materials conventionally used in snow conditions. Preferably, overboot 12 is made of neoprene. Additionally, the sole of the overboot is preferably textured as illustrated in provisional application Ser. No. 60/758,890. The cleats are made of a suitable metal material, such as stainless steel. Preferably the material used for the overboot upper is stretchy with reinforcement material strategically attached to the stretchy material for durability, to provide a means for buckle attachment for a non-stretchy (i.e., secure) strap harness and as a support. The metal cleats could be co-molded with the rubber outsole.

It is to be understood that although the drawings illustrate one overboot and one snowdeck, a complete system would, of course, be provided for each foot of the user.

Figure 8:
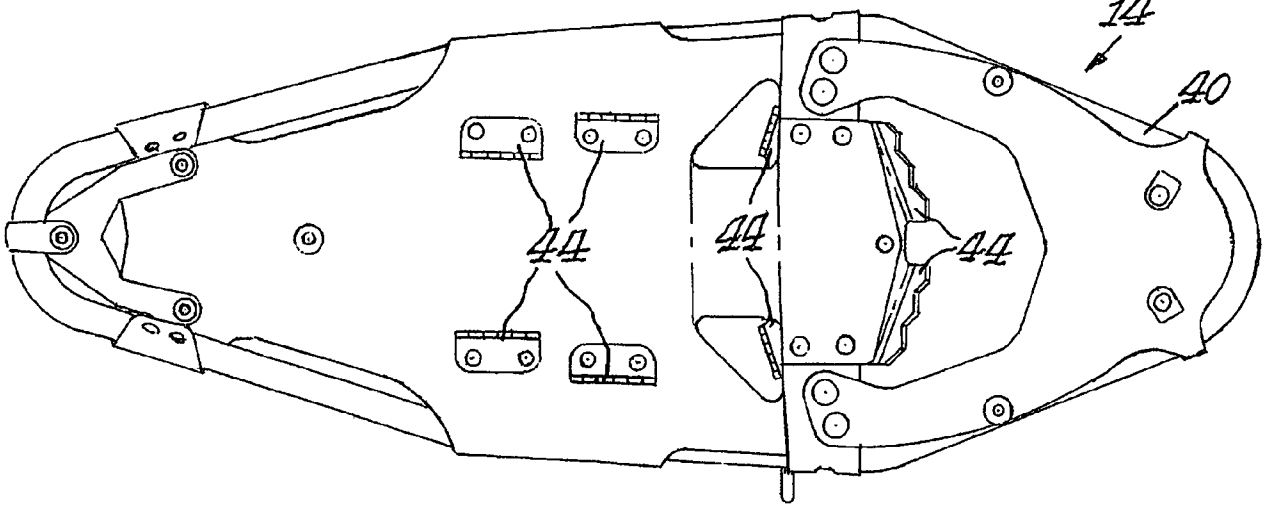
FIG. 8 is a bottom plan view of the snowdeck shown in FIGS. 5-7.

FIGS. 5-8 illustrate details of the snowdeck 14. As shown therein snowdeck 14 comprises a frame 40 which may be made of any suitable material such as a metal material conventionally used for snowdecks. Frame 40 has a generally flat portion which receives the overboot and may be inclined upwardly forwardly of where the user's foot (overboot) would be located. Any suitable decking material 42 spans the frame leaving openings as necessary or desired. As shown in FIG. 8 various sets of cleats or claws 44 are provided on the bottom of the decking 42 to further enhance traction for use on slippery surfaces and in deep snow. The claws 44 may be provided at any suitable locations and may be secured to webbing 42 in any suitable manner. Preferably the claws on one longitudinal side of the snowdeck 14 are mirror images of those on the other side.

A heel block 46 is mounted to a heel pad or support 48 provided on decking 42. Heel block 46 would be located between the sets of claws 44 located in the heel portion and would be of sufficient height to be surrounded by and generally elevate the overboot cleats 30,34 above decking 42 so as to not damage the decking when the overboot is mounted to the snowdeck by minimizing any digging of the cleats into the decking. The spacer aspect of the heel block may maintain the cleats generally out of contact but could permit some contact as long as damage to the decking is minimized. If desired, heel block 42 could include some form of catch, such as pins which may be selectively extended from the heel block, for engagement by the hook portion 38 of the cleats 34. Where, instead of a "snowdeck", the first traction component (e.g. overboot 12) is mounted to a ski, mounting to both the forefoot and rear foot may be desired. Accordingly, the term "snowdeck" is not intended to be limited to conventional snowdecks but could include various types of devices for attachment to the feet to assist movement in snow, such as snowdecks, skis or the like. For most uses of system 10, it is preferred that there be no physical attachment of the heel portion of the overboot with the snowdeck so that the user may readily pivot the user's foot by having attachment solely in the forefoot area as later described.

Heel block 46 may be mounted on the heel area decking 42 by being secured to the heel pad or support member 48 which contains a longitudinal slot 50 and two sets of transverse slots 52,52. See FIG. 6. This permits the location of heel block 46 to be varied for accommodating different size overboots. Thus, for example, heel block 46 could include engaging members detachably mounted in the front set of slots 52 to lock it in place or heel block 46 could be moved rearwardly in slot 50 and then engaged in rearward slots 52 where a larger size overboot is used.

The provision of a spacer such as heel block 46 to generally elevate the cleats of the traction component from the snowdeck 14 is a distinct advantage over prior arrangements. In that regard, a spacer assures that the cleats of a traction system in the heel area are prevented from generally contacting the snowdeck deck. Such spacer in the preferred form is a heel block, such as heel block 46 mounted directly to the snowdeck 14. The concept of a spacer, however, may also be practiced where, for example, the spacer is mounted (such as being detachably mounted) to the traction device or traction component so that it provides a spacing member of sufficient thickness to generally elevate the cleats from the snowdeck deck. The provision of such a spacer is advantageous over prior arrangements using, for example, cutouts in the snowdeck deck to avoid contact by the cleats of the traction system.

A key feature of this invention is the provision of a releasable locking mechanism 56 for selectively engaging the first traction component, such as overboot 12, with the snowdeck 14. The components of the releasable locking mechanism 56 are best shown in FIGS. 9-10 and its manner of operation is best illustrated in FIGS. 11-15.

Figure 9:
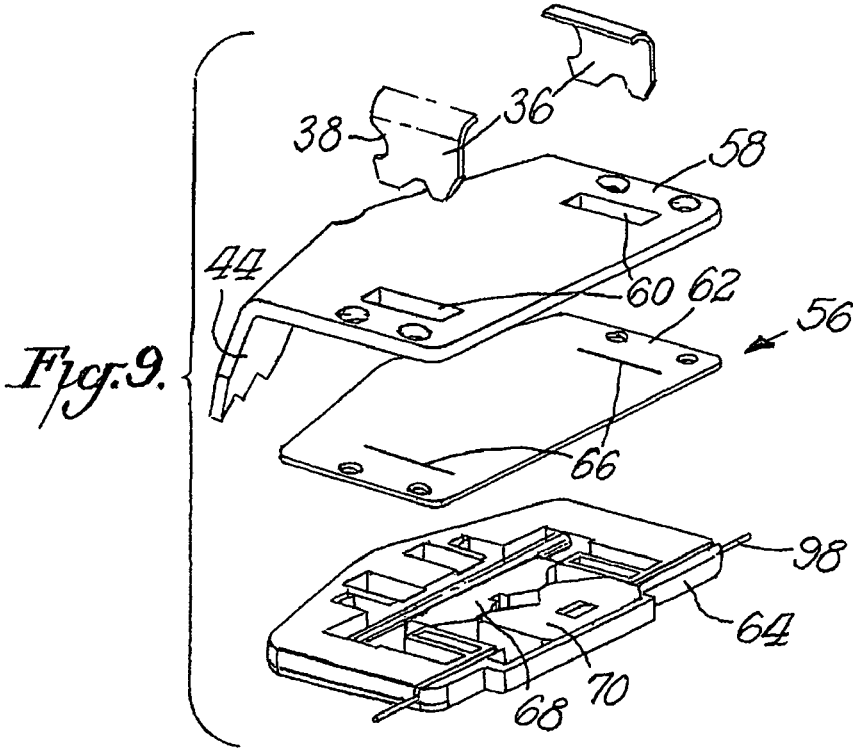
FIG. 9 is an exploded view showing traction cleats which would be mounted to the sole of the overboot and showing the components of the locking mechanism incorporated in the snowdeck in the system of FIG. 1.
Figure 10:
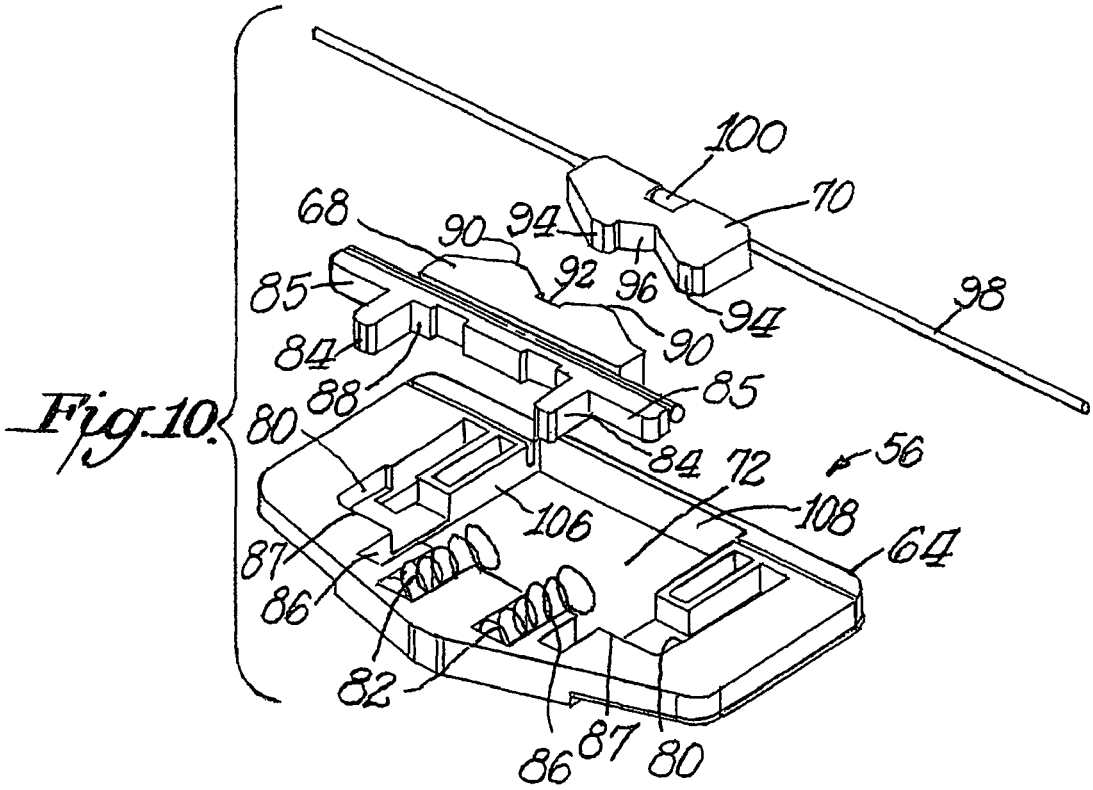
FIG. 10 is an exploded view showing components of the locking mechanism shown in FIG. 9.

As shown in FIG. 9 the traction cleats 36 of overboot 12 cooperate with the locking mechanism 56. The invention may be practiced where each cleat 36,36 is individually mounted to the sole 28 of overboot 12 by, for example, being embedded in an elastomeric mounting member which in turn is secured to the bottom of sole 28. Alternatively, cleats 36,36 and toe cleats 30,30 may be mounted to a common plate by being downward extensions of a plate 54 which would be incorporated in the sole 28 of overboot 12, such as illustrated in provisional application Ser. No. 60/758,890. It is to be understood that the invention could also be practiced where the cleats, particularly the cleats 36, are simply part of a binding that would be secured to conventional footwear and need not necessarily be part of an overboot.

FIG. 9 also illustrates the components of the releasable locking mechanism 56 that are incorporated in the snowdeck 14. These components include a plate 58 made of any suitable material such as metal which could have downwardly extending projections that form the claws 44. Plate 58 includes a pair of elongated slots 60 of a size and location to receive the cleats 36,36.

Under certain snow conditions it may be desirable to provide a gasket 62 mounted beneath the plate 58 which covers housing 64 in order to reduce snow or other contaminants infiltrating the locking mechanism. Gasket 62 is also provided with a pair of elongated slits 66 aligned with slots 60 of plate 58 so that the cleats 36 also extend through gasket 62. The slits 66 create a seal below slots 60 to minimize snow entering and contaminating the click-in locking mechanism.

Various components of the locking mechanism 56 located in housing 64 are illustrated in FIG. 10. As shown in FIG. 10 housing 64 includes a longitudinally movable slider 68 and a transversely movable slider 70 which fit in an appropriately shaped recess 72 of housing 64. Longitudinal slider 68 includes a groove 76 which receives a fastening rod 78 the ends of which would abut against walls 80,80 in housing 64. A pair of springs 82,82 are provided in housing 64. Longitudinal slider 68 has a pair of legs 84,84 which fit in appropriate recesses 86,86 in housing 64 when slider 68 is mounted in housing 64. Springs 82,82 press against wall 88 of longitudinal slider 68 to urge slider 68 in a longitudinal direction toward the opposite end of housing 64. Longitudinal slider 68 has a cam wall which includes a pair of projecting surfaces 90 and an intermediate recess 92.

Figures 5, 6, 7:
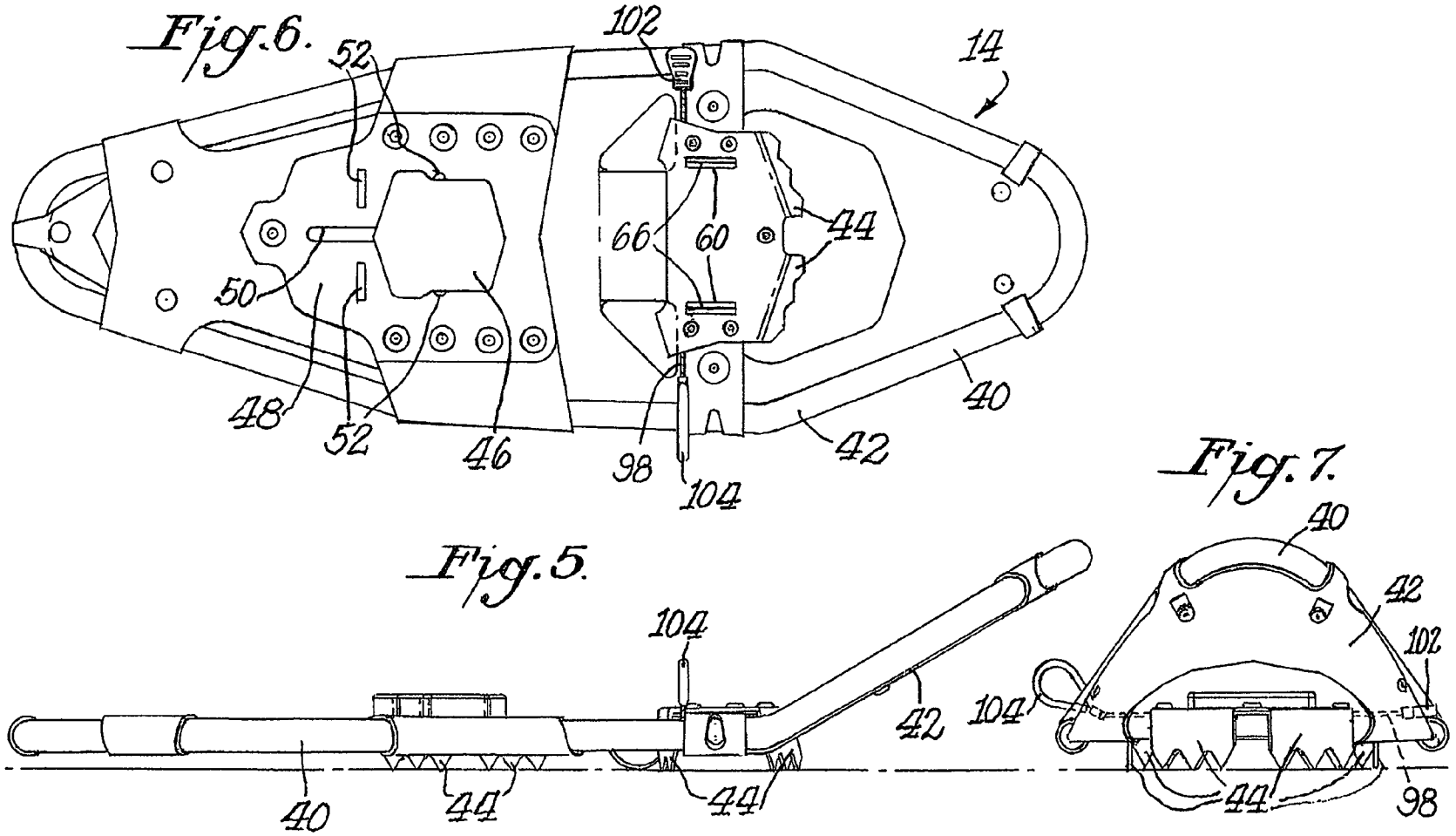
FIG. 5 is a side elevational view of a snowdeck used in the system of FIG. 1.
FIG. 6 is a top plan view of the snowdeck shown in FIG. 5.
FIG. 7 is a front elevational view of the snowdeck shown in FIGS. 5-6.
Figure 12:
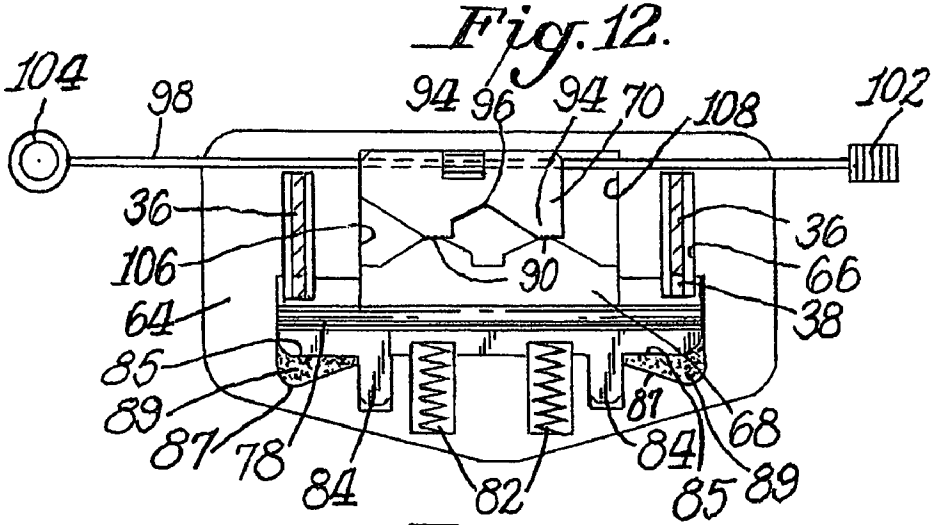
FIG. 12 is a top plan view of various components of the locking assembly shown in FIGS. 9-10 in the disengaged condition.
Figure 14:
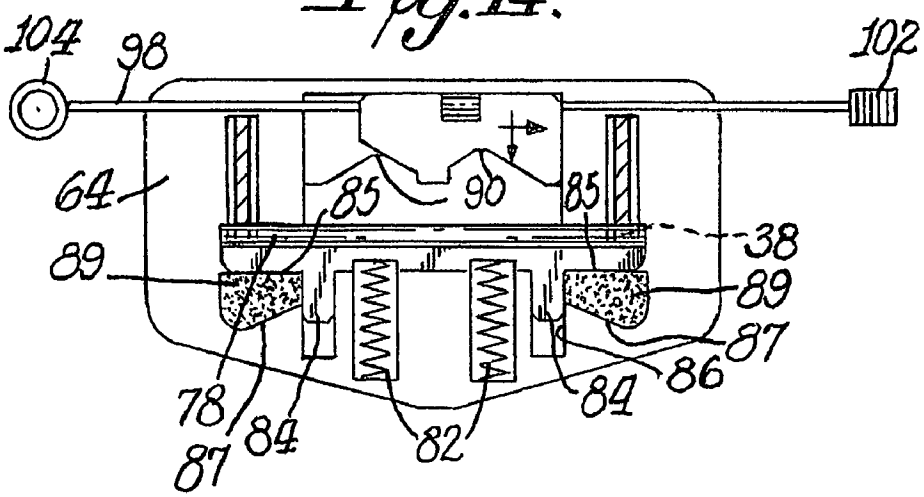
FIG. 14 is a view similar to FIG. 12 showing the components in the engaged position.

As also shown in FIG. 10 transverse slider 70 has a complementary cam wall which includes projections 94,94 and intermediate recess 96. The projections 90,90 of slider 68 and 94,94 of slider 70 preferably terminate in flat portions. A release/actuation member, such as a pull cord 98, is also provided in transverse slider 70. Pull cord 98 is fixedly mounted to sleeve 100 located in a notched portion of slider 70. Thus, when the pull cord is pulled to the right or to the left the slider 70 would also be shifted laterally to the right or to the left. As shown in FIGS. 6, 12 and 14 one end of pull cord 98 may have a handle 102 attached to that end, while the other end may have a handle 104. The handles may take any suitable form such as handle 102 being in the form of a block having grooves or ridges to facilitate gripping or could be a loop such as illustrated for handle 104.

Preferably the pull cord is made of a strong, yet bendable material such as a braided metal wire. Other suitable materials could be used and, although not as preferred, the pull cord itself could be a stiff non-bendable member since the main requirement is that it have sufficient strength to be pulled in a transverse direction and that it is coupled to the transverse slider so that the lateral pulling is transmitted to the transverse slider to cause the transverse slider to shift back and forth to and from its locking and unlocking conditions.

Figure 11:
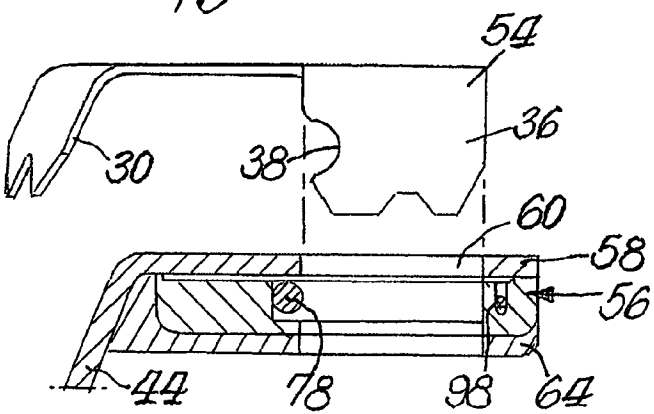
FIG. 11 is a fragmental exploded view showing components of the locking mechanism and the overboot cleats in an initial stage of mounting.
Figure 13:
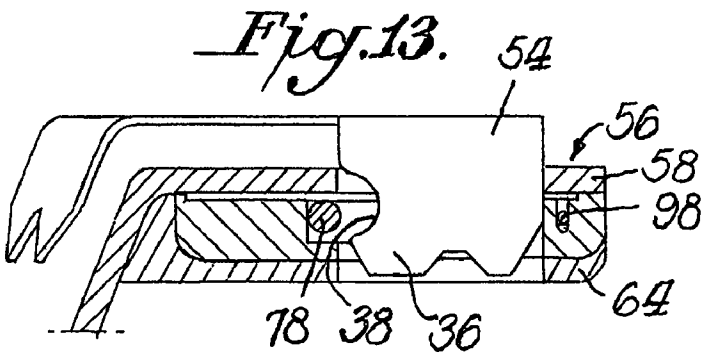
FIG. 13 is an elevational view in section showing the traction cleat of the overboot in the disengaged condition.
Figure 15:
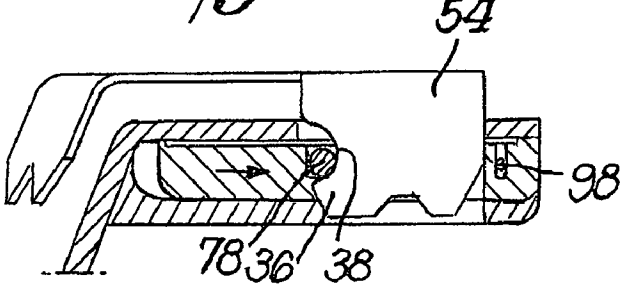
FIG. 15 is a view similar to FIG. 13 showing the components in the engaged position.

FIGS. 11-13 illustrate the condition of the locking mechanism when in the disengaged or the about to be engaged position. As shown therein handle or loop 104 has been pulled to move slider 70 toward the left. When in this position the cam faces of slider 70 press against longitudinal slider 68 to force the longitudinal slider 68 rearwardly with the springs 82 in a compressed condition. While in this position transverse slider 70 is disposed against wall 106 in recess 72 of housing 64 and is stopped in this position. The flat portions at the end of the projections 90 of longitudinal slider 68 and projections 94 of transverse slider 70 abut against each other to maintain longitudinal slider 68 in the retracted condition, best shown in FIG. 12. When in this position the fastening rod 78 is moved to its retracted or disengaged position out of the path of movement of cleats 36 when they enter the housing 64 through the slots 60,60 and 66,66 of the plate 58 and gasket 62. FIG. 11 shows the cleat 36 before it enters the slot 60. FIG. 13 shows how cleat 36 is able to freely pass into the housing 64 without interference from retracted fastening rod 78. In this manner, the wearer simply places the cleats 36,36 on the plate 58 of the snowdeck 14 at the location of the slots 60,60 and merely steps downwardly at the forefoot area to insert the cleats 36,36 into the locking mechanism 56.

After cleats 36 have been fully inserted into the housing 64 (FIG. 13), the wearer pulls handle 102 which causes transverse slider 70 to shift in the opposite direction from that shown in FIG. 12 to the position shown in FIG. 14. When in this position the side wall of slider 70 comes into contact with wall 108 of housing 64 and is stopped in this position. When moved to the position shown in FIG. 14 the projection cam surfaces 94,94 of transverse slider 70 no longer contact the projection cam surfaces 90,90 of longitudinal slider 68. Instead the recess 96 of transverse slider 70 is located at the right cam projection 90 of longitudinal slider 68 with the other or left cam projection 90 being against the complementary shaped inclined wall of the cam face of transverse slider 70 as illustrated in FIG. 14. Longitudinal slider 68 occupies this position by being urged outwardly under the influence of springs 82,82. When moved to this position, longitudinal slider 68 also carries fastening rod 78 forwardly with it whereby fastening rod 78 enters the exposed hook shaped portions 38,38 of cleats 36,36. This is then the locking or engaged condition of the locking mechanism 56. When in this locked condition overboot 12 is securely mounted to snowdeck 14 in the location of the traction cleats 36,36. As previously indicated in the preferred practice of this invention this is the only area where overboot 12 is locked to snowdeck 14 so that the wearer is thereby able to pivot the overboot in, for example, the heel area. The dimensions of traction cleats 36 with regard to the locking mechanism 56 and particularly the thickness of housing 64 is such that the cleats 30,32 and 36 remain elevated out of contact with the webbing 42. In that regard, cleats 30,30 and 32,32 surround the locking mechanism 56, while cleats 36,36 are in the locking mechanism. Since locking mechanism 56 is thicker than the length of these cleats, the cleats are thereby spaced from webbing 42.

When it is desired to remove overboot 12 from snowdeck 14 handle 104 is pulled to shift transverse slider 70 back to the position shown in FIG. 12 which results in returning longitudinal slider 68 to its retracted position so that fastening rod 78 is removed from hook portion 38 and cleats 36 can then be removed from the locking mechanism 56 by the wearer simply raising the foot away from the snowdeck 14. Alternatively, the locking mechanism 56 could remain in the locking condition and the wearer could simply remove the foot from the overboot so that the overboot 12 remains mounted to snowdeck 14 during periods of non-use. Thus the assembly which comprises the overboot 10 and the snowdeck 14 could be stored together as a single unit or could be separated from each other as previously described.

FIGS. 12 and 14 illustrate a further feature of this invention which operates to limit contamination of the releasable locking mechanism 56. As illustrated in FIGS. 10, 12 and 14 the housing 64 includes a recess 72. See FIG. 10. The longitudinal slider 68 includes a pair of legs 84,84 that are received in the portion of recess 72 designated by the reference numeral 86. An adjacent portion of recess 72 includes adjoining walls 87,87. These walls 87,87 are partially in line with lateral walls 85,85 of longitudinal slider 68 and partially extend toward slider 68.

As best shown in FIGS. 12 and 14 a pair of open areas is formed in recess 72 as defined by recess wall 87 in conjunction with longitudinal lateral wall 85 and legs 84. This open area if permitted to remain open would provide a site in which snow, ice and water could accumulate and ultimately could freeze thereby creating the potential of the latching mechanism freezing and being hampered in its operation.

In accordance with this invention each open area defined by a corresponding set of walls 85, 87 and leg 84 is filled, preferably completely filled, with a filler member 89. In the preferred practice of this invention the filler member 89 is a compressible silicone foam insert. Thus, when the locking mechanism 56 is in the condition shown in FIG. 14 the open space is of maximum area, but is completely filled by filler member 89. When the longitudinal slider 68 moves to the position shown in FIG. 12 the open area or space is reduced in size and yet remains completely filled by the filler member 89 which becomes compressed.

As a result, by occupying the space with the filler member, contamination is limited in the latching mechanism which has dramatically improved the function of that mechanism in snow and ice conditions by eliminating occasional freezing of the mechanism.

The above practice of the invention may be considered as comprising a base member which is the housing 64 with the base member having the recess for accommodating the longitudinal slider 68. The transversely movable slider 70 functions as a control member to move the longitudinal slider 68 to and from its first and second positions shown in FIGS. 12 and 14. The two spaces in which the filler member 89 is inserted are laterally aligned with each other an equal distance from the longitudinal center line of the base member or housing 64. Although the figures illustrate the leg 84 and the wall 85 to be perpendicular to each other, other shapes could be used. What is important is that the leg moves into a corresponding recess 86 and that the leg, in combination with its adjacent wall on the longitudinal slider, forms the space as further defined by the wall 87 of the recess.

The filler member is preferably made of a resilient compressible material so that it can substantially fill the space in either the large area of the space shown in FIG. 14 or the smaller area shown in FIG. 12 where the filler member has been compressed.

Preferably, the filler member occupies a substantial portion of the space, namely, at least one half of the space or at least three-quarters of the space and most preferably completely fills the space. The filler member is preferably a removable insert which could simply be laid in place in the space and easily removed when it is desired to have a fresh clean filler member.

Although the above description and the drawings include the provision of an exposed hook 38 in the cleat 36 which is engaged by the locking mechanism, other forms of latch members may be used. For example, instead of an exposed hook, the latch member could be a hole or cutout in the cleat which would be selectively engaged by the movement of a bar functioning as the catch member in the locking mechanism. Such bar could be a bar of circular cross-section fitting in a circular or round hole or cutout. Alternatively, the latch might be a protrusion on the cleat 36 which would be engaged with a catch movable into the path of movement of the protrusion when the traction cleat 36 has entered the locking mechanism. The locking mechanism itself could take any suitable form such as being part of a strap system which would have a catch member movable into the path of movement of the latch.

It is to be understood that where reference is made to a releasable locking mechanism, such locking mechanism could be of the type specifically illustrated and described or could be a strap system incorporating the components to effect the selective engagement and disengagement with the cleat of the traction component.

An advantageous feature of this invention is that an audible click is heard when the transverse slider is moved to its locking condition and is moved to its unlocking condition. This provides assurance to the wearer that the overboot has been appropriately locked to or released from the snowdeck.

The present system provides an advantageous manner of mounting the traction component to the snowdeck deck. When, for example, the cleat 36 is mated with the locking mechanism and in particular with the plate 58 by entering its slot 60, the cleat 36 is held strongly from rotating in nearly all planes even without the bar or rod 78 being clicked into place. This "nesting" of the two components assures a very secure connection and allows the cleat 36 to be removed by moving it in the vertical direction in a single plane perpendicular to the slot. Thus, while the click-in bar is important, there is still much stability built into the design even without the bar.

The preferred practice of this invention utilizes a set of two traction cleats 36,36 which cooperate with the locking mechanism having two sets of slots. The invention, however, could also be practiced with only one or with more than two of such traction cleats 36 with appropriate modification of the locking mechanism.

It is to be understood that the above description with regard to the illustrated preferred embodiment of this invention is not intended to be limiting and that the invention could be practiced with different variations. Reference is made to provisional application Ser. No. 60/758,890, filed Jan. 12, 2006, all of the details of which are incorporated herein by reference thereto. Among the variations described in that provisional application are the use of a detachable binding for the snowdeck instead of an overboot whereby the binding could be attached to suitable footwear such as running shoes. Thus, the cleats 36 described with regard to the overboot, could be part of a separate binding where the invention is practiced without an overboot. Other variations described in the provisional application include the use of a cradle which could be inserted within an overshoe, which would be another alternative to the use of the overboot described and illustrated in FIGS. 2-4.

What is claimed is:

1. A snowdeck having a latching mechanism for detachably mounting to a traction component, said mechanism including a base member mounted to said snowdeck, said base member having a recess, a longitudinal slider mounted in said recess for selective longitudinal movement to and from a first position and a second position, said slider having a longitudinal wall and a lateral wall, said recess having a wall partially opposite said lateral wall, a space defined by said lateral wall and said longitudinal wall of said slider and by said recess wall, said space being larger when said slider is in said first position than when said slider is in said second position, and a filler member in said space.

2. The snowdeck of claim 1 wherein said filler member is made from a compressible resilient material.

3. The snowdeck of claim 2 wherein said filler material substantially fills said space.

4. The snowdeck of claim 2 wherein said filler material completely fills said space.

5. The snowdeck of claim 2 wherein said filler member is made of a foam material.

6. The snowdeck of claim 5 wherein said foam material is a silicone foam.

7. The snowdeck of claim 1 wherein there are two of said spaces.

8. The snowdeck of claim 7 wherein said two spaces are in lateral alignment with each other equidistant from the longitudinal centerline of said base member.

9. The snowdeck of claim 1 wherein longitudinal wall is a wall of a longitudinal leg, and said lateral wall is perpendicular to said longitudinal wall.

10. The snowdeck of claim 9 wherein a portion of said recess wall is generally parallel to said lateral wall and an adjoining portion of said recess wall extends toward said lateral wall.

11. The snowdeck of claim 1 including a control member for controlling the movement of said longitudinal slider to and from said first position and said second position.

12. The snowdeck of claim 11 wherein said control member is a lateral slider mounted in said recess against said longitudinal slider.

13. The snowdeck of claim 1 wherein said filler member is a removable and replaceable insert.

* * * * *